United States Patent [19]

Harada et al.

[11] 4,048,966

[45] Sept. 20, 1977

[54] VACUUM ADVANCE CONTROL SYSTEM

[75] Inventors: Masanori Harada, Yokohama; Shinzo Katou, Sagamihara; Nobuyuki Hayashi, Yokosuka, all of Japan

[73] Assignee: Nissan Motor Company, Yokohama, Japan

[21] Appl. No.: 596,193

[22] Filed: July 15, 1975

[30] Foreign Application Priority Data

July 29, 1974 Japan ..... 49-90201[U]

[51] Int. Cl.[2] ..... F02P 5/04

[52] U.S. Cl. ..... 123/117 A; 74/860; 123/117 R

[58] Field of Search ..... 123/117 A, 117 R, 146.5 A; 74/860

[56] References Cited

U.S. PATENT DOCUMENTS

| | | | |
|---|---|---|---|
| 2,473,805 | 6/1949 | Mallory | 123/117 A |
| 3,584,521 | 6/1971 | Tooker et al. | 123/117 A X |
| 3,783,847 | 1/1974 | Kolody | 123/117 A X |
| 3,812,831 | 5/1974 | Scott, Jr. et al. | 123/117 A |

*Primary Examiner*—Carroll B. Dority, Jr.
*Assistant Examiner*—Tony M. Argenbright

[57] ABSTRACT

The vacuum advance control system to control the spark timing is disclosed. It comprises the application of a vacuum from the intake manifold of an engine to an advance control in the engine distributor through a vacuum line wherein the intake manifold vacuum controls the spark timing, an air bleed orifice opening to the vacuum line at an opening formed therein; an orifice provided in the vacuum line between the opening and the source of application of the vacuum from the intake manifold so as to prevent excessive flow of air into the engine carburetor and the intake manifold; and means for bleeding an ambient air into the vacuum line through the air bleed orifice. A second air bleed orifice is provided in the system and is at all times open to the ambient air.

9 Claims, 2 Drawing Figures

VACUUM ADVANCE CONTROL SYSTEM

The present invention relates to a vacuum advance control system to lower the amount of pollutants such as NOx, CO and hydrocarbons expelled from an internal combustion engine. More particularly the invention relates to a vacuum advance control system to retard a spark timing advance that would be otherwise obtained at a given engine speed when the exhaust purification is demanded and to advance a spark timing to realize full power from the engine when the full power from the engine is demanded.

A typical vacuum advance mechanism used on conventional contact-point distributors contains a spring-loaded, air-tight diaphragm connected by a linkage, or lever to a breaker plate in the distributor. The breaker plate is supported on a suitable bearing so that it can turn with respect to the distributor housing. The spring loaded side of the diaphragm is connected through a suitable vacuum line to an opening in the carburetor which in turn, communicates with the intake manifold.

In a conventional vacuum advance control system a solenoid operated valve is provided to permit a predetermined amount of ambient air into the vacuum line when in a change speed transmission following the engine low gear or second gear or third gear is selected and to prevent the air bleed when top gear is selected. The solenoid of the valve is electrically circuited with a solenoid actuator such that when the solenoid actuator is energized in response to the selection of the transmission thus supplying a pulsating current to the solenoid, the valve will cyclically open an air bleed orifice opening to the vacuum line. To prevent excessive flow of fresh air into the carburetor and intake manifold, an orifice is provided in the vacuum line between the opening of the air bleed orifice and the carburetor. The operation of the above mentioned construction and arrangement is as follows: when any one of low gear, second gear and third gear positions is selected (during this operating mode exhaust gas purification being required), the air bleed orifice is cyclically opened by the solenoid valve thus bleeding an ambient air into the vacuum line with the result that the vacuum level in the vacuum lowers and a spark is retarded as compared to the spark advance that would be otherwise obtained at a given vacuum in the manifold (a vaccum advance characteristic is shown and designated by the reference character A in FIG. 1); and when top gear position is selected (during this operating mode realization of full power from the engine being required), the air bleed orifice is completely closed by the solenoid valve with the result that a fully advanced spark at a given vacuum in the intake manifold is obtained (a vacuum advance characteristic is shown and designated by the reference character B in FIG. 1).

One shortcoming encountered in the above mentioned system is that the transmission of vacuum decrease in the intake manifold to the advance control mechanism is delayed since the orifice provided in the vacuum line to prevent excessive flow of fresh air into the carburetor restricts air flow thereacross, and thus the engine is apt to knock during rapid acceleration because a spark remains advanced more than the spark advance that otherwise would be obtained at an intake manifold vacuum at the full throttle.

It is therefore an object of the present invention to mitigate the above mentioned shortcoming encountered in the conventional vacuum advance control system.

It is a specific object of the present invention to provide a vacuum advance control system to control the spark timing in an internal combustion engine with a distributor, the vacuum advance control system comprising: the application of a vacuum from the intake manifold to an advance control in the distributor through a vacuum line wherein the intake manifold vacuum controls the spark timing; an air bleed orifice opening to the vacuum line at an opening formed in the wall thereof; an orifice provided in the vacuum line between the opening and the source of application of the vacuum from the intake manifold; and means for bleeding an ambient air into the vacuum line through the air bleed orifice, in which a second air bleed orifice is provided in the vacuum advance control system and is at all times open to the ambient air.

The above and other objects, features and advantages of the present invention will become clear from the following description and the accompanying drawings, in which.

Figure 2:
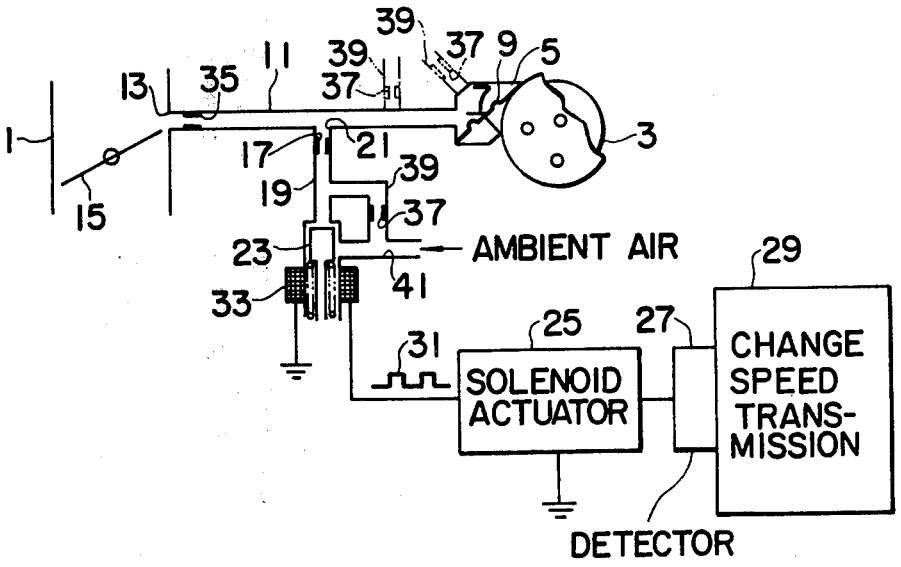
FIG. 2 is a schematic view of a preferred embodiment of a vacuum advance control system according to the present invention.

Referring to the accompanying drawings and particularly to FIG. 2, there are illustrated a conventional carburetor 1 of an internal combustion engine, a distributor breaker plate 3 spring biased to a retarded spark timing setting position (spring being not shown), a vacuum servo means 5 for moving the distributor breaker plate 3 in an advanced spark timing direction in response to increase in a vacuum applied to a vacuum chamber 7 to which a flexible diaphragm 9 of the vacuum servo means 5 is exposed and a vacuum line 11 connecting a spark vacuum port 13 of the carburetor 1 that is located on atmospheric side or above the idle speed position of a throttle valve 15.

Air bleed orifice 17 in an air bleeder conduit 19 opens to the vacuum line 11 at 21 in the wall thereof. A solenoid operated air bleed valve 23 is disposed in the air bleeder conduit 19 to normally close same. The solenoid valve 23 is electrically circuited with a solenoid actuator 25 which is connected to a detector 27 attached to a change speed transmission 29 following the engine. The construction and arrangement of the solenoid valve 23, solenoid actuator 25 and detector 27 is such that when the solenoid actuator 25 is triggered by the detector 27 in response to the selection of low gear or second gear or third gear position in the transmission 29 and provides a pulsating current 31 to a solenoid 33 of the valve 23, the valve 23 will be actuated by the solenoid 33 to cyclically open the air bleeder conduit 19, thereby bleeding ambient air into the vacuum line 11 through the orifice 17.

Orifice 35 is provided in the vacuum line 11 and disposed at a location between the opening 21 and the carburetor 1 to prevent excessive flow of fresh air into the carburetor 11 and intake manifold (not shown).

Second air bleed orifice 37 in an air bleeder conduit 39 opens to the first air bleeder conduit 19 at a location between the air bleed orifice 17 and the air bleed valve 23 and the opposite end of the air bleeder conduit 39 opens to a vent conduit 41, thus bypassing the valve 23. If desired such an air bleeder conduit 39 provided with an orifice 37 may open to the vacuum line 11 at a location in the wall thereof between the opening 21 and the vacuum servo 5 or it may open to the vacuum servo 5 so as to directly bleed the ambient air into the vacuum chamber 7 (see imaginary lines).

Figure 1:
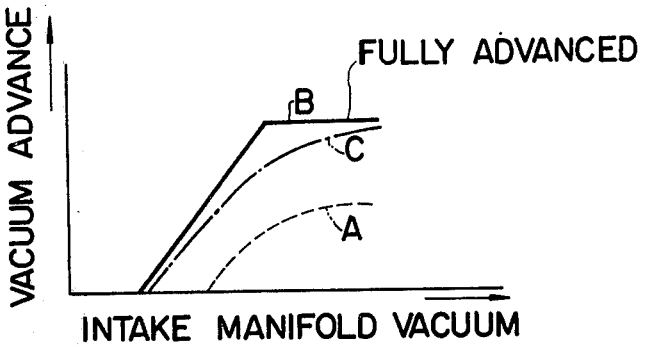
FIG. 1 is a diagrammatic graph showing vacuum advance curves.

The areas of the first air bleed orifice 17 and second air bleed orifice 37 are selected so that when the solenoid valve 23 is cyclically opened and closed in response to pulsating current 31 provided by the solenoid actuator 25, a sufficient amount of air enough to lower the vacuum about a predetermined percent to obtain the vacuum advance curve A (see FIG. 1) enters the vacuum line 11, and when the valve 23 is completely closed a lesser amount of air enters the vacuum line 11 so as to provide a vcuum advance curve C (see FIG. 1) which is retarded from the fully advanced vacuum curve B that would be otherwise obtained if the air bleed orifices 17 and 37 were closed. It will be appreciated that with a spark along with the vacuum advance curve C full power from the engine is almost realized because the retardation from the full advanced setting position is not so great. It will also be appreciated that with the vacuum advance control system of the present invention, since the air bleed orifice 37 permits a small amount of ambient air into the vacuum line 11 even when the solenoid valve 23 is closed during the engine operation with top gear position of the transmission 29, the vacuum servo 5 will respond immediately to decrease in vacuum in carburetor 1 during rapid and heavy acceleration operation of the engine with the transmission 29 in top gear position. Thus the engine knocking during rapid acceleration of the engine is eliminated.

It may well be understood that the vacuum advance control system of the invention can be used in such a modified manner that the solenoid valve 23 is cyclically opened when low gear or second gear position is selected and the valve 23 is closed when third gear or top gear position is selected.

What is claimed is:

1. In an internal combustion engine having a carburetor with a spark port above the idle speed position of the throttle valve, a distributor breaker plate spring biased to a retarded spark timing setting position;

vacuum servo means having a vacuum chamber for moving said distributor breaker plate in an advanced spark timing direction in response to vacuum in said vacuum chamber;

a vacuum line connecting said vacuum chamber to said spark port, said vacuum line having a first orifice therein adjacent said spark port;

a conduit having one end opening to the interior of said vcuum line at a position between said first orifice and said vacuum chamber of said vacuum servo means and other end opening to the atmosphere, said conduit having a second orifice therein;

solenoid valve means normally closing said conduit at a position intermediate said second orifice and said other end of said conduit, said solenoid valve means being operative upon energization thereof to open said conduit to bleed an ambient air into said vacuum line through said conduit;

means for cyclically energizing said solenoid valve means during a predetermined range of operating conditions of the engine; and air bleed orifice means for bleeding an ambient air into said vacuum line.

2. An internal combustion engine as claimed in claim 1, in which said air bleed orifice means communicates with said vacuum line through said second orifice.

3. An internal combustion engine as claimed in claim 1, in which said air bleed orifice means bypasses said solenoid valve means.

4. An internal combustion engine as claimed in claim 1, in which said air bleed orifice means communicates with said vacuum line at a location between said first orifice and said vacuum chamber of said vacuum servo means.

5. An internal combustion engine as claimed in claim 1, in which said air bleed orifice means communicates with said vacuum chamber of said vacuum servo means.

6. In an internal combustion engine having a carburetor with a spark port above the idle speed position of the throttle valve and associated with a transmission, a distributor breaker plate spring biased to a retarded spark timing setting position;

vacuum servo means having a vacuum chamber for moving said distributor breaker plate in an advanced spark timing direction in response to vacuum in said vacuum chamber;

a vacuum line connecting said vacuum chamber to the spark port, said vacuum line having a first orifice therein adjacent said spark port;

a conduit having one end opening to the interior of said vacuum line at a position between said first orifice and said vacuum chamber of said vacuum servo means and other end opening to the atmosphere, said conduit having a second orifice therein;

solenoid valve means normally closing said conduit at a position intermediate said second orifice and said other end of said conduit, said solenoid valve means being operative upon energization thereof to open said conduit to bleed an ambient air into said vacuum line through said conduit;

means for cyclically energizing said solenoid valve means when the transmision is shifted into a low speed position; and air bleed orifice means for bleeding an ambient air into said vacuum line.

7. An internal combustion engine as claimed in claim 6, in which said air bleed orifice means communicates with said vacuum line through said second orifice.

8. An internal combustion engine as claimed in claim 6, in which said air bleed orifice means bypasses said solenoid valve means.

9. An internal combustion engine as claimed in claim 6, in which said air bleed orifice means communicates with said vacuum line at a location between said first orifice and said vacuum chamber of said vacuum servo means.

* * * * *